United States Patent [19]

Desjarlais

[11] 4,307,171

[45] Dec. 22, 1981

[54] NEGATIVE-WORKING DIAZO TYPE PHOTOREPRODUCTION HAVING IMPROVED D-MIN AND LINE ACUITY

[75] Inventor: Robert C. Desjarlais, South Hadley, Mass.

[73] Assignee: James River Graphics, Inc., South Hadley, Mass.

[21] Appl. No.: 160,650

[22] Filed: Jun. 18, 1980

[51] Int. Cl.[3] ..... G03C 1/58; G03C 1/60; G03C 5/18

[52] U.S. Cl. ..... 430/147; 430/157; 430/177; 430/179

[58] Field of Search ..... 430/147, 177, 179, 157

[56] References Cited

U.S. PATENT DOCUMENTS

| | | | |
|---|---|---|---|
| 2,727,820 | 12/1955 | Botkir | 430/179 |
| 3,365,293 | 1/1968 | Haefeli et al. | 430/157 |
| 3,453,112 | 7/1969 | Schaeffer | 430/179 |
| 3,512,978 | 5/1970 | Lubar | 430/147 |
| 4,252,884 | 2/1981 | Bennett | 430/147 |

OTHER PUBLICATIONS

Chemical Abstracts, #89:120,859w, 1978 [Belgian Pat. 860,040-2/1978 (Bennett, E].

Kosar, J., "Light-Sensitive Systems", J. Wiley & Sons, 1965, pp. 292-296.

*Primary Examiner*—Charles L. Bowers, Jr.

*Attorney, Agent, or Firm*—Burns, Doane, Swecker & Mathis

[57] ABSTRACT

Negative-working diazography material is comprised of (i) at least one hexafluorophosphate diazonium salt adapted to photolytically cleave into an acid catalyst, (ii) at least one acid labile enolic, preferably arylenolic blocked-coupler adapted to be converted in the presence of acid to an active azo-coupling component, and (iii) an effective amount of at least one additive such as benzotriazole, urea, thiourea and derivatives thereof. The additives are believed to react with the acid released during imaging to the extent that migration thereof into the areas which have not been exposed to light is reduced or eliminated. The reduction in the migration of the liberated acid improves the D-min and line acuity of the image obtained from the formulation and the presence of the additive provides a means for decreasing the photo speed of the formulation.

27 Claims, 1 Drawing Figure

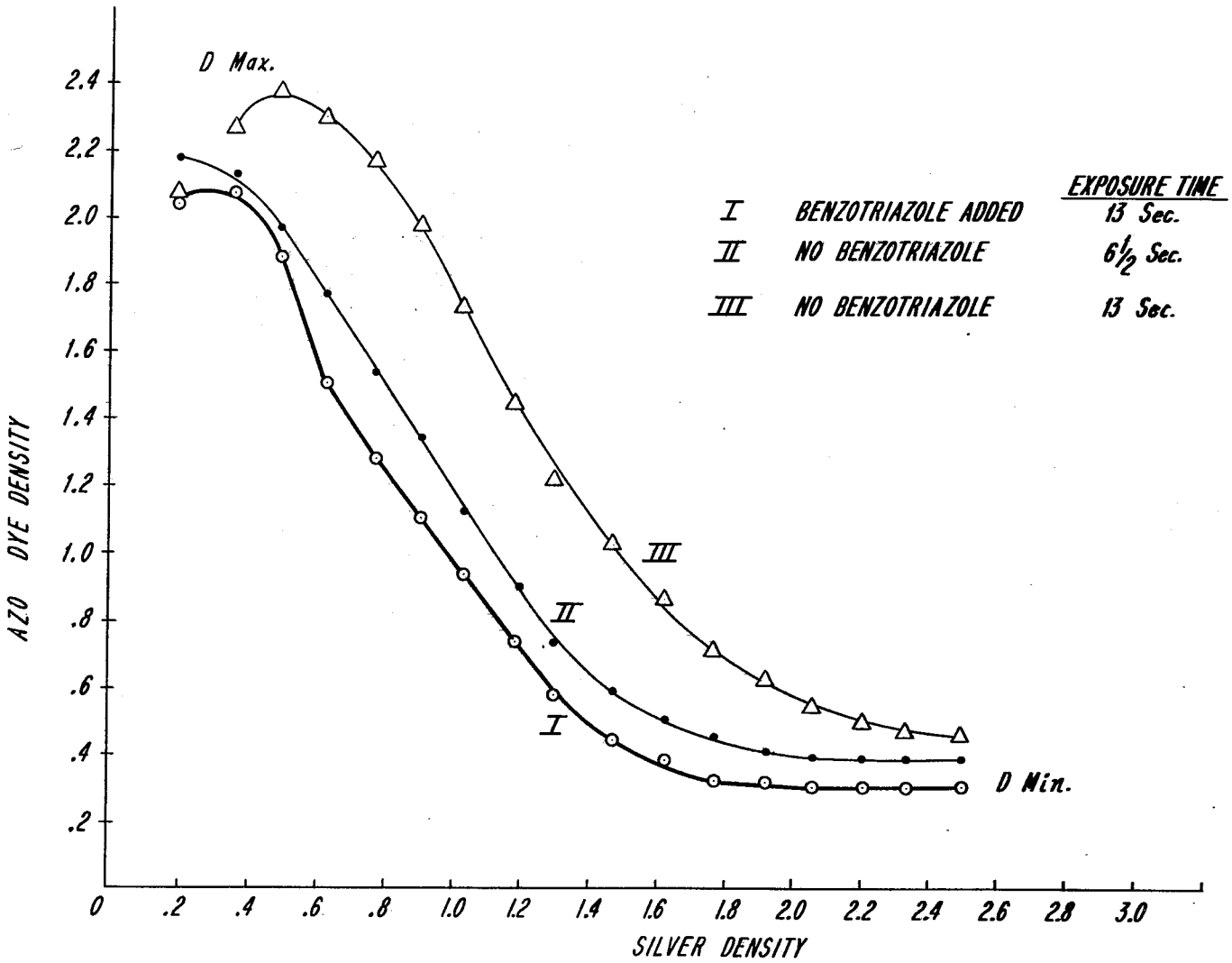
EXPOSURE TIME
13 Sec.
6½ Sec.
13 Sec.
I BENZOTRIAZOLE ADDED
II NO BENZOTRIAZOLE
III NO BENZOTRIAZOLE
D Max.
D Min.
I
II
III
AZO DYE DENSITY
SILVER DENSITY
0
.2
.4
.6
.8
1.0
1.2
1.4
1.6
1.8
2.0
2.2
2.4
2.6
2.8
3.0

NEGATIVE-WORKING DIAZO TYPE PHOTOREPRODUCTION HAVING IMPROVED D-MIN AND LINE ACUITY

BACKGROUND OF THE INVENTION

1. Field of the Invention

The present invention relates to negative-working diazotype photoreproduction and, more especially, relates to a negative-working diazotype photoreproduction system adapted to utilize conventional diazonium salts in combination with a blocked-coupler which is activated by acid.

2. Description of the Prior Art

Diazotype photoreproduction is of course a standard in the graphic arts. The touchstone of the diazography processes is the light-sensitivity of aromatic diazo salts and the fact that such salts undergo two different types of reaction: [1] replacement or decomposition, in which nitrogen is lost or evolves as nitrogen gas and some other atom or group attaches to the benzene ring in its stead; and [2] "coupling", wherein the nitrogen of the diazo function is retained and the salts react with certain couplable color-forming components, i.e., a "coupler" or "azo-coupling component", to effect formation of an azo dye species.

The photochemical sensitivity of the compounds typically employed in diazotype photographic reproduction ["photoreproduction"] materials resides in the near-ultraviolet region of the spectrum, and is centered about 400 nm [nanometers, one nm being equal to a millimicron or $10^{-9}$ meter]. Photographic diazo processes may be divided into two basic categories: positive-working processes and negative-working or reversal, processes. In the former category, the action of light causes photochemical decomposition of the diazo compound. An image is developed in the unexposed areas by the combination of the diazo compound with a "coupling" component, which is generally an aromatic amine, phenol, or aliphatic compound containing active methylene groups, to form colored oxyazo or aminoazo compounds known as azo dyes.

The positive-working material is imaged by first exposing it through a master transparency or original. The light in the exposure step must supply sufficient energy to destroy the diazo compound in the areas corresponding to the clear background of the original. High-pressure mercury vapor lamps are generally used in performing this step. That part of the diazo coating which is unprotected from the ultraviolet radiation by the image on the original becomes a colorless substance, incapable of coupling to form a dye. The unaffected diazo compound which remains in those areas where the light has not struck is able to form an azo dye by reaction with a coupling component when the medium is made alkaline. Thus, wherever there was an opaque line on the original, a dye-line appears on the copy. Positive-working, diazotype photoreproduction material is generally made alkaline, or pH adjusted, either by impregnating the material with ammonia vapors or passing it through an alkaline developing solution. See generally U.S. Pat. Nos. 1,444,469; 1,628,279; 2,217,189; 2,286,701; 2,429,249; and 2,694,009; German Patentschriften Nos. 56,606; 111,416; 487,247; and 515,205; British Pat. Nos. 234,818; 281,604; and 521,492.

In the negative-working or reversal process, a dye is formed in the exposed areas, but not in the areas protected from light. See U.S. Pat. Nos. 2,034,508 and 2,095,408; German Patentschriften Nos. 53,455 and 82,239. Thus a negative, or reversed, copy of the original transparency results. Among the processes employing diazo compounds to produce reversal copies are those employing diazosulfonates. Illustrative thereof is U.S. Pat. No. 2,854,338 to Herrick et al., wherein a neutral or acid photosensitive material is exposed to actinic light and developed in ammonia vapors. Residual diazosulfonate is removed from the unexposed areas and the background cleared by washing in water. In accordance with a more recent process, disclosed in U.S. Pat. No. 3,479,183 to Habib et al, an alkaline imaging material is exposed to actinic illumination to convert the diazosulfonate to an active diazonium compound which combines with a coupling component to provide a reverse dye-image. Since the generation of the imaging diazonium is thus accomplished principally by the incident radiation, powerful light sources must be used for exposing the diazotype material. After imaging, the material is acidified and the unreacted diazosulfonate is light-cleared by exposing it to overall actinic illumination, thereby forming colorless decomposition products of the diazosulfonate to produce a stable, negative dye-image against a clear background. Cf. the U.S. Pat. No. 3,713,825 to Girard; U.S. Pat. No. 1,926,322 to Van der Grinten.

Another negative-working process which utilizes diazo compounds to produce azo dye images is the diazo-oxide mode of photoreproduction.

The basic operating differences between the diazosulfonate and diazo-oxide reversal processes are as follows, reference being made to "Decomposition of o-Hydroxy-Diazonium Compounds by Light," J. DeJonge and R. Dijkstra, Recueil, 67, (1948) pp. 328–342:

[1] The irradiation product of o-hydroxy benzene diazonium compounds is a cyclopentadiene carboxylic acid while the irradiation product of benzene diazosulfonate is the structurally isomeric diazo compound itself. As a result of the light decomposition, the practical and significant difference between the negative diazosulfonate process and the diazo-oxide reversal process is the fact that a wide variety of azo dye colors may be produced from diazosulfonate coupler combinations whereas only one azo dye may be produced from each diazo-oxide. The cyclopentadiene-carboxylic acid decomposition product couples much more rapidly than phenolic, naphthol or pyrazalone couplers [see page 335, paragraph 2 of the aforementioned article].

[2] The cyclopentadiene carboxylic acid formed as a result of decomposition under actinic light is a very active coupling component and forms red azo dyes with the diazonium compound.

[3] The fixing or prevention of image formation in the unexposed portions of diazo-oxide coated support requires that there be complete elimination of moisture or adjustment of the coated support to extremely high acid levels. This requirement need not be met with certain of the diazosulfonates.

Nonetheless, it too is well known to this art that negative-working diazography based on either diazosulfonate or diazo-oxide chemistry leaves much to be desired in terms of product imaging characteristics, namely, the diazosulfonate films required long exposure times to effect isomerization of the noncoupling trans-isomer to the reactive cis-form needed to provide an azo dye image. Additionally, the need for impractically lengthy fixing exposures likely shall continue to militate against widespread use of this approach. Insofar as the diazo-oxide based films are concerned, same, in effect, generate coupler in situ through partial decomposition of the diazo moiety. The film is cleared by postdevelopment exposure to destroy background diazo. The diazo-oxide films are also apparently quite limited in density and re-exposure schemes for enhancing image density by several successive re-exposure/cycles have been proposed. Cf. U.S. Pat. No. 4,108,664 to deBoer et al; U.S. Pat. No. 4,094,681 to Habib et al.

Yet another negative-working system features a "vesicular" film which is exposed to actinic radiation to form a latent nitrogen gas image therein from a preselected master image. The nitrogen gas evolves upon the light decomposition of the diazonium salt, and upon storage, the nitrogen would slowly diffuse out of the film. However, upon heating, the nitrogen expands and forms small visible bubbles or vesicles in the film. Thus, vesicular imaging is, in reality, a foaming process of sorts; same is essentially confined to single-component systems applicable to projection imaging, or microfiche/reader uses. Compare, for example, the U.S. Pat. Nos. 3,149,971; 3,355,295; 3,779,768; 3,779,774; 3,841,874; and 3,979,211.

In the U.S. Pat. No. 4,055,425 to Mustacchi, a diazotype material is described comprising a light-sensitive, water-insoluble diazoamino compound, an azo coupler, and an alkaline material, said diazoamino compound, when exposed to ultraviolet light, being reactive with said azo coupler to form a visible dye product only at a pH greater than 7. Such diazotype material can be used for diazotype reproduction processes resulting in either negative or direct positive images. Such material necessitates use of rather exotic equipment and, in the negative-working mode, treatment with an external acid source is mandated, and can be corrosive to the equipment. In addition, the processing entails an extra step in the photoreproduction sequence.

"Thermal" processes are also common to the art; U.S. Pat. Nos. 3,303,028; 3,499,760; 3,695,885; and 3,899,335.

Compare also the negative-working variant disclosed in the U.S. Pat. No. 3,765,895 to Fox wherein free-radical precursors are activated by photodecomposition of a diazonium salt. This patent features the ability of diazoniums to yield a free-radical by homolytic cleavage of the C-N bond, does not entail the formation of azo dyes or ammonia development, and, indeed, such process is operable even in the absence of diazo salt.

Other variations on the theme are suggested by, e.g., U.S. Pat. Nos. 1,857,920; 2,095,408; 2,381,984; 2,416,021; 2,516,931; 2,976,145; 3,140,180; 3,307,952; 3,331,689; 3,563,744; 3,620,740; 3,769,018; and 3,793,033; British Pat. No. 975,457.

In view of the above noted technology and in response to the need to develop a simple negative-working diazography process a number of formulations were discovered which are disclosed in U.S. patent application Ser. No. 66,401, of E. W. Bennett, filed on Aug. 14, 1979, the disclosure of which is herein incorporated by reference.

The primary components of this formulation comprise (1) at least one diazonium compound, (2)an inactive blocked-coupler and (3) a specifically defined photolabile, or light-sensitive acid progenitor.

In a preferred embodiment, the diazo compound and light-sensitive acid progenitor constitute the same compound. This is achieved when the diazonium compound is a diazo salt comprising a complex anion of an inorganic Lewis acid. Thus, in this embodiment the diazonium compound functions as either a reactant source for the formation of an azo dye species upon reaction with an activated coupler, or as an acid generating compound wherein a controlled amount of light decomposes the diazonium salt thereby releasing nitrogen and a Lewis acid.

The above described formulation is employed in a negative-working imaging process wherein the formulation is typically provided in the configuration of a film. The film is subjected to an imagewise exposure of light in a manner sufficient to generate catalytic amounts of acid from, for example, the photolabilie diazonium salt. Preferably aided by heating, the liberated acid reacts with the inactive blocked-coupling agent to unblock its functional group, and impart to the unblocked coupler the potential to react with the diazonium salt. The reaction between the diazonium salt and the coupling agent is induced in a developing stage wherein th film is subjected to an alkaline environment, preferably, at elevated temperatures, to form the azo dye.

The unreacted diazonium compound is preferably decomposed in a clearing step by exposing the developed film to actinic light, e.g., for about 60 seconds.

While the above processes and formulations employed therein have many advantages over those of the prior art described herein, the search has continued for ways to improve the D-min and line acuity of the resulting image.

The present invention was developed as a result of this search.

Accordingly, it is an object of the present invention to improve (i.e., reduce) the D-min of images derived from certain negative-working diazography formulations described herein employing acid activated block-coupling components to thereby improve the visual appearance of the same.

It is a further object of the present invention to improve the line acuity of images provided from certain negative-working diazography formulations described herein which employ acid activated blocked-coupling components.

It is a still further object of the present invention to provide a means for decreasing the photo speed (i.e., increase the duration of the imaging step) of certain negative-working diazography formulation.

These and other objects and features of the invention will become apparent from the claims and from the following description.

SUMMARY OF THE INVENTION

In one aspect of the present invention there is provided a light-sensitive diazography formulation comprising (i) at least one light-sensitive hexafluorophosphate salt of a diazonium compound adapted to photolytically cleave into an acid catalyst, (ii) at least one acid labile enolic, preferably arylenolic blocked-coupler adapted to be converted in the presence of acid to an active azo-coupling species and (iii) an effective amount of at least one additive selected from the group of compounds represented by the structural formulae:

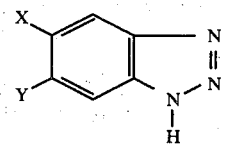

[I]

wherein X and Y are selected from the group consisting of hydrogen, chlorine and methyl provided at least X or Y is hydrogen; and

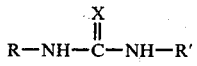

[II]

wherein R and R', which can be the same or different, are selected from the group consisting of alkyl of from 1 to about 5 carbons; hydrogen; or together constitute a cyclic hydrocarbon group of from about 2 to about 8 carbons; and X selected from the group consisting of oxygen and sulfur; said effective amount being sufficient to improve the line acuity of images obtainable from said formulation.

In another aspect of the present invention there is provided a light-sensitive diazotype photoreproduction material, comprising a support member coated with the abovedescribed diazography formulation.

In still another aspect of the present invention there is provided a negative-working diazography photoreproduction process, comprising imagewise exposing the abovedescribed diazotype formulation to light of a quality and quantity sufficient to photochemically liberate catalytic amounts of acid therefrom, thus unblocking coupler molecules, and thence developing said diazotype material under alkaline conditions such that azo-coupling species couple with undecomposed diazonium compound in the light-struck areas to form azo dye.

The incorporation of the aforenoted additives, such as benzotriazole, into the diazography formulation has been found to improve (i.e., reduce) the D-min and also to improve line acuity of the images derived therefrom. By decreasing D-min, the visual appearance of the films employing the described diazography formulation is improved. The simultaneous improvement in line acuity is particularly advantageous because it improves the clarity of the image. Improved line acuity is critical to certain applications such as the photographing of an engineering drawing which contains many fine lines. The aforenoted additives also provide a means for increasing the light exposure time needed to give a particular diazo density.

BRIEF DESCRIPTION OF THE DRAWING

The FIGURE depicts three plots of silver density versus diazo density derived in accordance with the procedures of the Example.

DESCRIPTION OF THE PREFERRED EMBODIMENTS

The present invention is derived from the discovery that when diazography formulations of the type described in U.S. patent application Ser. No. 66,401, filed on Aug. 14, 1979, now U.S. Pat. No. 4,252,884 wherein at least one of the diazonium compounds is a diazo salt having hexafluorophosphate ($PF_6$) as the complex anion, are subjected to imagewise exposure to light in the imaging step, some of the acid released thereby, i.e., $PF_5$, migrates laterally within the film thereby reducing the line acuity of the ultimate image.

The aforedescribed improvements are achieved by incorporating controlled amounts of at least one additive which can be represented by the structural formula:

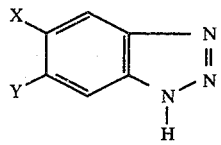

[I]

wherein X and Y are selected from the group consisting of hydrogen, chlorine and methyl provided at least X or Y is hydrogen; or the structural formula:

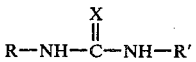

[II]

wherein R and R', which can be the same or different can be alkyl, preferably alkyl of from 1 to about 5 carbons; hydrogen; or together constitute a cyclic hydrocarbon group of from about 2 to about 8 carbons (e.g., 6 carbons); and X is oxygen or sulfur.

Representative examples of suitable additives which correspond to the structural formulae I and II include benzotriazole; 5-methylbenzotriazole; 6-methylbenzotriazole; urea; thiourea; dibutylurea; dibutylthiourea; dimethylurea; dimethylthiourea and the like.

The most preferred additive is benzotriazole.

The aforenoted additives not only function to scavenge the migratory acid liberated during the imaging step but they also possess an unexpected combination of advantageous properties in that they do not alter the color stability of the formulation mix, they are inactive in the presence of the diazo salts employed in the formulation, and they are soluble in low molecular weight solvents typically employed in preparing said formulations.

The light-sensitive diazotype reproduction formulation which is improved by the addition of said additives comprises (i) at least one complex, light-sensitive hexafluorophosphate salt of a diazonium compound adapted to photolytically cleave to yield an acid species (ia) and a diazonium salt (ib), and (ii) at least one enolic, preferably arylenolic, such as phenolic and naphtholic, blocked-coupler, or precursor of an azo-coupling component adapted to be converted in the presence of the acid species (ia) into an active azo-coupling component.

The above-described formulation is employed in a process which comprises the imagewise exposure of the aforenoted diazography formulation to irradiation, e.g., actinic light, of a quality and quantity sufficient to generate catalytic amounts of acid from the photolabile diazonium salt, said catalytic amounts being sufficient to effect conversion of the inactive precursor of azo-coupling component into an active azo-coupling component, and thence subjecting the thus exposed diazotype material to an alkaline developing environment, thereby enabling the active azo-coupling component formed in the light-struck areas to couple with the diazonium compound to form an azo dye.

Thus, the imaging process employing the diazography formulation described herein utilizes a negative-working diazonium process that involves two essential process steps; namely, the imagewise exposure to light, typically in the UV or blue region of the spectrum [e.g., for from 8–12 seconds or longer; with certain formulations, however, exposure times of 3 seconds or less are fully operative], and a weak moist ammonia atmosphere development. In a preferred embodiment of this process, the imaging or light exposure step is followed by a heating step, e.g., to a temperature of from about 100° to about 210° F., preferably from about 120° to about 200° F. (e.g., 160° to about 190° F.) for a period of about 5 to about 15 seconds, preferably from about 7 to about 10 seconds (e.g., 8 seconds) to enhance the intensity of the image which is ultimately obtained. The development chamber containing the moist ammonia atmosphere is also preferably heated to similar temperatures. The above-described method results in a negative image which is obtained directly from the diazonium material without requiring a second printing step to accomplish the sign reversal of the image as with positive-working diazo in conjunction with silver.

The underlying principles set forth in the above-described U.S. patent application Ser. No. 66,401, by which the diazography formulation operates is believed to involve the release of acid from the diazonium salt in response to exposure to light and the subsequent removal of the blocking group from the coupler molecule by acid cleavage thereof. Consequently, when the film is developed, the unblocked coupler reacts with the remainder of the diazonium salt to form the diazo dye image only in the light-struck areas. Thus, the more intense the light in a particular area of film the darker will be the image because more of the acid will be released.

The acid release mechanism is illustrated by the following sequence:

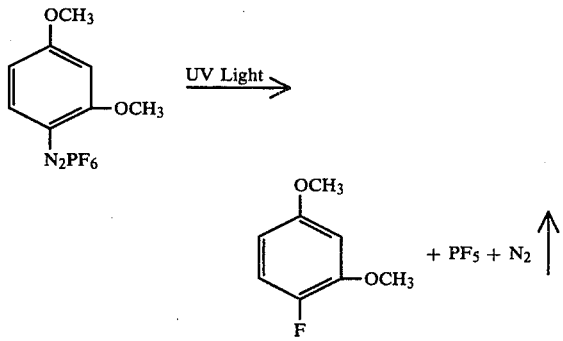

The resulting $PF_5$ complexes with a blocked-coupler in accordance with the following illustrative reaction sequence:

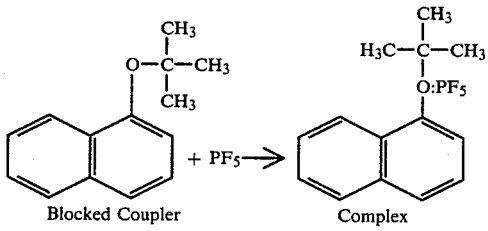

While not wishing to be bound to or by any particular theory or mechanism of reaction, it is likely that the photochemically induced removal of the blocking group from the enolic or arylenolic oxygen of the coupler molecule, resulting in the formation of a dye image only in the light-struck areas, can proceed either by intramolecular rearrangement of the coupler molecule, or via the acid cleavage thereof.

For example, the $PF_5$ complex ultimately undergoes intramolecular rearrangement to form the active coupler species:

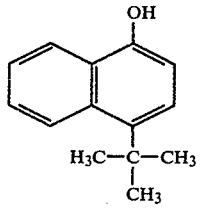

and/or acid cleavage thereof into the likewise active coupler species:

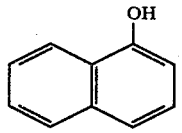

The formation of the $PF_5$ complex and active coupler species is aided by the application of heat.

When the $PF_5$ released upon exposure to light migrates laterally to areas in the film which have been exposed to light of different intensity, it will ultimately result in the production of azo dye in amounts which exceed that which would otherwise have formed in direct response to the light. This gives rise to a loss in line acuity of the resulting image.

When one of the aforedescribed additives, such as benzotriazole, is introduced into the formulation, it is believed to act as a scavenger to accept the $PF_5$ which is undesireably released during the imaging step and which would otherwise migrate and undesireably react thereafter with the blocked-coupler. For example, the $PF_5$ and benzotriazole reaction product is believed to be represented by the following structure:

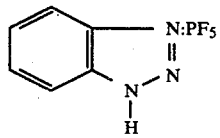

While the aforedescribed additives are believed to exert their scavenging effect primarily by reaction with the species $PF_5$, some of the acid cleavage which results in unblocking of the coupler may also be caused by acid species which are derived by hydrolysis of the $PF_5$ with the water in a humid environment. For example, the $PF_5$ may hydrolyze to form the following acid species:

$$PF_5 \xrightarrow{4H_2O} 5HF + H_3PO_4$$

or $$PF_5 \xrightarrow{H_2O} POF_3 + 2HF$$

$$POF_3 \xrightarrow{3H_2O} 3HF + H_3PO_4$$

The aforedescribed additives are also believed to react with the acid species derived from hydrolysis of the $PF_5$ thereby substantially reducing the release of the hydrolysis products of the former to the extent desired.

Thus, the diazography formulation of the present invention comprises, in addition to the diazonium salt and the blocked-coupler, an effective amount of at least one of the aforedescribed additives.

The particular amount of said additive employed in the formulation will be affected by the temperature utilized to activate the coupler subsequent to imaging. For example, as the temperature to which the light exposed formulation is heated is increased, more of the acid will be liberated and react in a shorter period of time. While elevated temperatures would be expected to increase the image denisty, the amount of acid which can potentially migrate and react is also increased. Consequently, as a general rule the higher the activation temperature the higher the amount of additive which must be employed.

If the amount of additive in the formulation is too high, however, too much of the acid released during the imaging step will be inactivated and not enough of the blocked-coupler will be activated, i.e., unblocked resulting in low density images.

If the amount of additive in the formulation is too low, however, the scavenging effect will not be obtained.

Consequently, the amount of said additive in the formulation is controlled in a manner sufficient to obtian a scavenging effect to the extent that the image density (i.e., D-min) and line acuity is improved and yet insufficient to adversely affect the activation of the blocked-coupler.

Accordingly, while any effective amount of said additive may be employed in the diazography formulation, it is preferred that such effective amount be sufficient to achieve a molar ratio of additive to diazonium salt of from about 1:20 to about 1:100, preferably from about 1:30 to about 1:80, and most preferably from about 1:40 to about 1:75, respectively.

THE BLOCKED-COUPLERS

The blocked-couplers which may be employed in the diazography formulation contain enolic, preferably, arylenolic, such as phenolic and naphtholic, groups which are blocked through an acid sensitive or labile oxygen bridge to a "blocking" moiety. Suitable blocked-couplers include those described in commonly assigned U.S. patent application Ser. No. 66,401, filed Aug. 14, 1979 the disclosure of which is herein incorporated by reference.

Such blocked-couplers are incapable of reacting with any diazonium salt present to effect formation of an azo dye up and until such time as acid catalysis has unblocked the active enolic or phenolic coupler species.

The preferred arylenolic blocked-couplers are of the genera: tertiary ethers, and the various acetal, ketal and MEM ether derivatives of phenols. The tertiary ether phenols comprise a tert-blocking group linked through an acid labile bond via an oxygen atom to an aryl coupler moiety and have the structural formula:

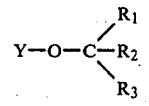

[III]

wherein each R, which may be the same or different but which cannot be hydrogen, is alkyl, preferably straight or branched chain lower alkyl of from 1 to 8 carbons; aryl, preferably aryl of from 6 to 10 carbons; cycloalkyl, preferably cycloalkyl of from 3 to 8 carbons; aralkyl and alkaryl, wherein the alkyl and aryl portions thereof are as above defined; and wherein Y is aryl, e.g., phenyl, naphthyl, and the like. Moreover, any two or three of said R substituents may be linked together to form a tert-cyclic, bicyclic or heterocyclic structure. Also, any one or more of the R and Y moieties may itself or themselves be substituted by any one or more substituents not atypical to diazotype photoreproduction components, and which will not interfere with the acid catalyzed unblocking chemistry above described.

The acetal derivatives have the structural formula:

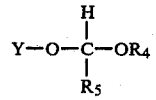

[IV]

and the ketal derivatives, the structural formula:

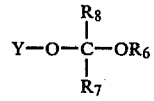

[V]

wherein Y and each R, which also may be the same or different, are as above defined, except that in the formula [IV] the $R_5$ moiety, but not $R_4$, can also be hydrogen. Also as above defined, any two or three of said R substituents may be linked together to form a cyclic, bicyclic or heterocyclic structure. Similarly, the various Y and R moieties may be either substituted or unsubstituted.

Additionally, in the above formulae [III], [IV] and [V], any R and Y may be taken together to define a fused or polycyclic basic nucleus, e.g., naphthyl or diphenyl, and R may even be Y.

Also included are compounds of the type:

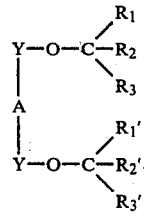

[VI]

wherein each R is as above defined and A is any suitable bridging atom, group, e.g., alkylene, or direct chemical bond.

The MEM ether acetals are especially attractive and correspond to those having the structural formulae:

$$Y—O—CH_2—O—CH_2—CH_2—OCH_3$$ [VII]

and

-continued

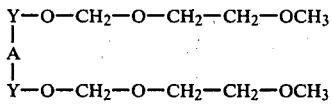

[VIII]

wherein Y and A are as above defined.

A further class of preferred blocked-couplers can be represented by the structural formula:

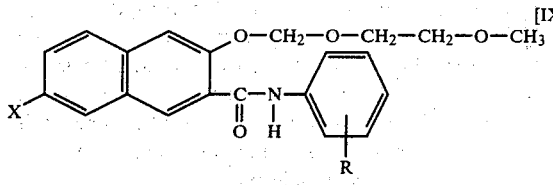

[IX]

wherein X is selected from the group consisting of hydrogen, bromine, and methoxy, and R can represent alkyl, preferably lower alkyl of from about 1 to about 8, most preferably from about 2 to about 4 carbons; alkoxy wherein the alkyl group is as defined above in connection with formula [III]; acyl; and halogen selected from the group consisting of chlorine, bromine, fluorine and iodine.

Representative blocked-couplers thus include the following:

| Structure | Chemical Name |
|---|---|
| 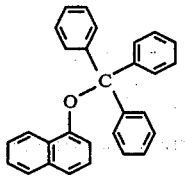 | 1-naphthyl-triphenyl-methyl ether |
| 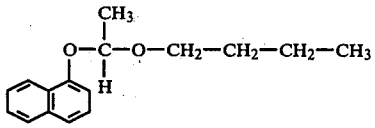 | 1-butoxy-1-(1-naphthoxy)ethane |
| 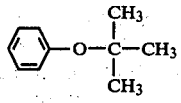 | t-butyl phenylether |
| 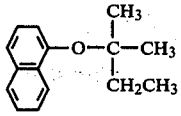 | 2-(1-naphthoxy)-2-methyl-butane |
| 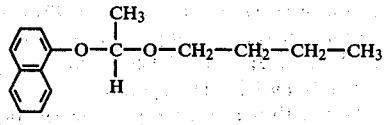 | 1-(1-butoxy)-1-(1-naphthoxy)ethane |
| 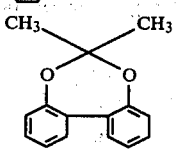 | Dibenzo(d,f)-2,2-dimethyl-1,3-dioxepine |
| 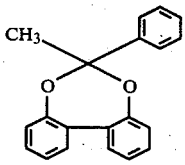 | Dibenzo(d,f)-2-methyl-2-phenyl-1,3-dioxepine |
| 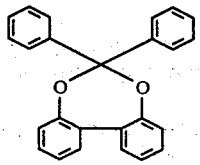 | Dibenzo(d,f)-2,2-diphenyl-1,3-dioxepine |

-continued

| Structure | Chemical Name |
|---|---|
| 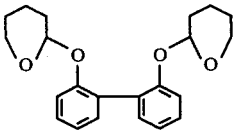 | 2,2[1]-di(2-tetrahydro-pyranoxy)diphenyl |
| 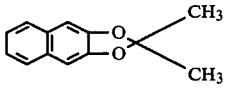 | 2,3-isopropylidene-dioxynaphthalene |
| 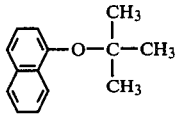 | t-butyl-1-naphthyl ether |
| 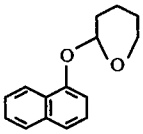 | 1-naphthyl-2-tetra-hydropyranyl ether |
| 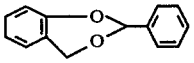 | Benzo(e)-2-phenyl-1, 3-dioxin |
| 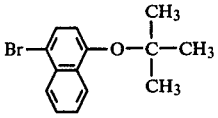 | t-butyl-(4-bromo-1-naphthyl) ether |
| 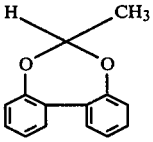 | Dibenzo(d,f)-2-methyl-1,3-dioxepine |
| 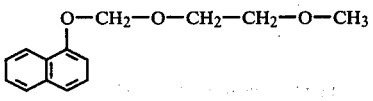 | β-methoxyethoxymethyl-α-naphthylether |
| 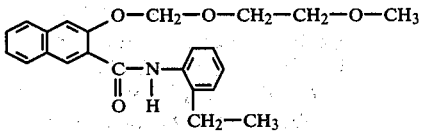 | 3-(methoxyethoxymethoxy)-N-(2-ethylphenyl)-2-naphthalamide |
| 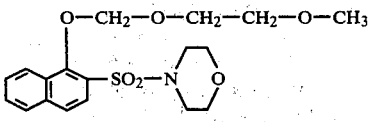 | 2-(morpholinosulfonyl)-1-(methoxyethoxymethyl)-naphthyl ether |
| 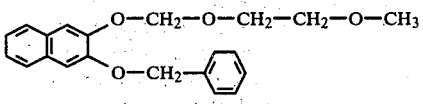 | 3-benzyloxy-2-(methoxy-ethoxymethyl)naphthyl ether |
| 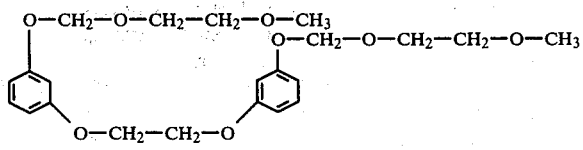 | Bis(3-methoxyethoxymethoxy-1-phenylene)ethylene diether |
| 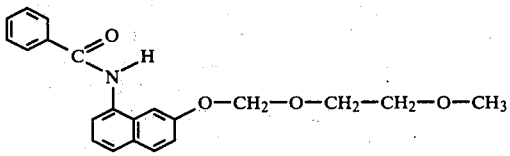 | 8-N-benzoylamino-2-(methoxy-ethoxymethyl)naphthyl ether |
| 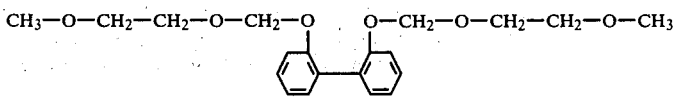 | 2,2'-methoxyethoxymethoxy biphenyl |

-continued

| Structure | Chemical Name |
|---|---|
| 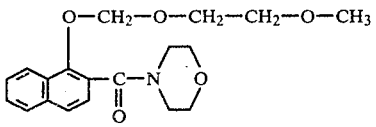 | 2-(morpholinocarbonyl)-1-(methoxyethoxymethyl)-naphthyl ether |
| 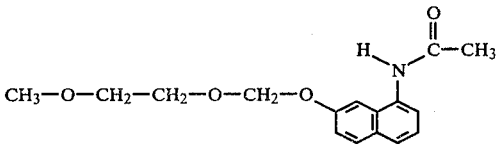 | 5-N-acetylamino-3-(methoxyethoxymethyl)-naphthyl ether |
| 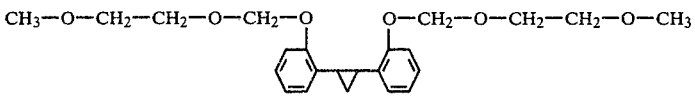 | 1,2-Bis(2,2'-methoxy-ethoxymethoxyphenyl)-cyclopropane |
| 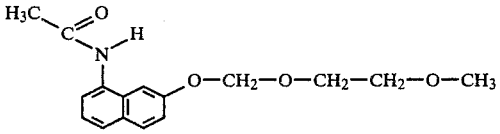 | 8-N-acetylamino-2(methoxy-ethoxymethyl)naphthyl ether |
| 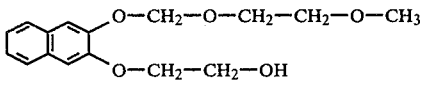 | 3-(2-hydroxyethoxy)-2-(methoxyethoxymethyl)-naphthyl ether |

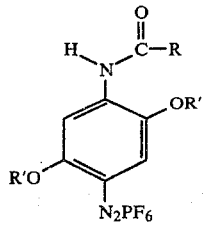

[X]

THE DIAZONIUM SALT

As described above, the acid for the unblocking reaction in the present invention is derived from a diazonium salt. Any of the known diazonium compounds capable of forming a positive image in a conventional diazo element are suitable for producing a negative image in the diazo formulation of the present invention and are therefore suitable for use as the source of the cation in the diazonium salt.

Illustrative of the aromatic diazonium cations comprising the photosensitive salts utilized in accordance with the present invention are the following:

(1) p-Chlorobenzenediazonium;
(2) 2,4-Dichlorobenzenediazonium;
(3) 2,5-Dichlorobenzenediazonium;
(4) 2,4,6-Trichlorobenzenediazonium;
(5) p-Methoxybenzenediazonium;
(6) O-Methoxybenzenediazonium;
(7) 4-Chloro-2,5-dimethyoxybenzenediazonium;
(8) 2,4,5-Triethoxy-4-biphenyldiazonium-(2,5-diethoxy-4-(p-ethoxyphenyl)benzenediazonium);
(9) 2,5-Dimethoxy-4'-methyl-4-biphenyldiazonium-(2,5-dimethoxy-4-(p-tolyl-benzenediazonium);
(10) 2,5-Diethoxy-4-(phenylthio)benzenediazonium;
(11) 2,5-Diethoxy-4-(p-tolylthio)benzenediazonium;

The anion of the diazonium salts which has been found to release an acid which is suitably scavenged by benzotriazole is hexafluorophosphate, $PF_6^-$.

The most preferred diazonium salts include those represented by the following generic structural formula:

wherein R can represent hydrogen; alkyl, preferably straight or branched chain lower alkyl of from 1 to about 10, most preferably from about 1 to about 3 carbons; aryl, preferably aryl of from 6 to about 10 carbons, most preferably 6 carbons;cycloalkyl, preferably cycloalkyl of from 3 to about 6 carbons, most preferably from about 4 to about 6 carbons; aralkyl and alkaryl, wherein the alkyl and aryl portions thereof are as defined above; alkoxy, preferably alkoxy of from about 1 to about 5 carbons, most preferably from about 1 to about 3 carbons; alkylthio, preferably alkylthio of from about 1 to about 5 carbons, most preferably from about 1 to about 3 carbons; alkoxymethyl, preferably alkoxymethyl of from about 1 to about 5 carbons, most preferably from about 1 to about 3 carbons; aryloxymethyl, preferably aryloxymethyl wherein the aryl group contains from about 6 to about 10 carbons, most preferably about 6 carbons; arylthiomethyl, preferably arylthiomethyl wherein the aryl group contains from about 6 to about 10 carbons, most preferably about 6 carbons; trifluoroalkyl wherein the alkyl is as described above; and furanyl; and R' which can be the same or different can represent alkyl, aryl, cycloalkyl, and aralkyl as defined above in connection with R with the proviso that R' cannot be tertbutyl; hydroxyalkyl wherein the alkyl group contains at least 2 carbons, and preferably from 2 to about 5 carbons; methoxyalkyl wherein the alkyl group contains at least 2 carbons, preferably from 2 to about 5 carbons (e.g., 2 carbons); and allyl containing at least 3 carbons, preferably from 3 to about 5 carbons (e.g., 3 carbons).

Representative examples of suitable R and R′ groups which can be associated together in an individual compound represented by structural formula [X] include the following:

| R′ | R |
|---|---|
| 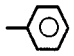 | $-H$ |
| 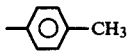 | $-CH_3$ |
| 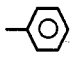 | $-CH_2-CH_3$ |
| $-CH_3$ | $-\overset{CH_3}{\underset{CH_3}{\overset{\mid}{\underset{\mid}{C}}}}-CH_3$ |
| $-CH_2-CH_3$ | $-CH_2-OCH_3$ |
| $-CH_2-CH_2-O-CH_3$ | 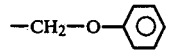 |
| $-CH_3$ | 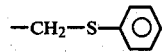 |
| 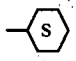 | $-O-CH_3$ |
| 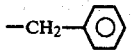 | $-S-CH_3$ |
| 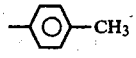 | 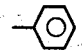 |
| $-CH_2-CH_2-OH$ | 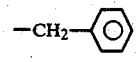 |
| $-CH_3$ | $-CF_3$ |
| $-CH_2-CH_3$ | 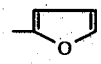 |
| $-CH_3$ | $-CH_3$ |
| $-CH_2-CH=CH_2$ | $-CH_3$ |
| $-CH_3$ | 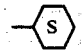 |

Other suitable diazonium salts which may be employed include those represented by the structural formula:

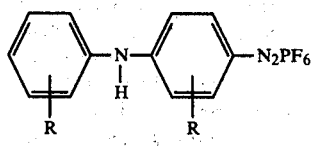

[XI]

wherein R, which may be the same or different is as defined in connection with structural formula [X].

A third class of suitable diazonium salts include those represented by the structural formula:

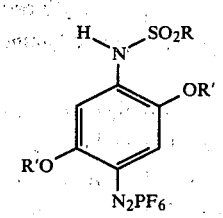

[XII]

wherein R and R′ are as defined in connection with structural formula [X].

The diazonium salts described by structural formula [X] are particularly preferred because they possess a unique balance of properties when employed in a negative-working diazography formulation even in the absence of the additives described herein.

The particular advantages associated with this class of diazonium salts can best be described with reference to the properties of diazonium salts represented by structural formula [X] and those represented by the structural formulae [XI] and [XII].

For example when compounds of structural formula [XII] are employed in a negative-working diazography formulation the developing time necessary to achieve full density in the film image is substantial, e.g., about 50 seconds. Compounds of structural formula [XI], however, require that the temperature-time ratio which governs the heating step during which unblocking of the blocked coupler occurs be adjusted to allow for either higher temperatures or longer heat exposure times (e.g., the film must make several passes, e.g., about 5, through the heating zone) to achieve the desired results. The compounds of structural formula [X], however, exhibit the most desirable balance between developing time and the temperature-time ratio during the heating step. Thus, the developing time of this class of compounds is about $\frac{1}{8}$ as long as that of compounds described by structural formula [XII] and the heating time during unblocking of the coupler at a given temperature is about $\frac{1}{8}$ as long as that of compounds described by structural formula [XI]. In short, the diazonium salts of structural formula [X] achieve a higher maximum dye density (D-max) than those of either structural formulae [XI] or [XII] for any given set of the aforenoted processing conditions.

Representative examples of suitable diazonium salts include the following:

(1) O-Chlorobenzenediazonium hexafluorophosphate;
(2) p-N-Dimethylaminobenzenediazonium hexafluorophosphate;
(3) O-Methoxybenzenediazonium hexafluorophosphate;
(4) 2,4-Dimethoxybenzenediazonium hexafluorophosphate;
(5) 2,5-Diethoxy-4-[4′-chlorophenoxy]benzenediazonium hexafluorophosphate;
(6) 4-Benzyloxybenzenediazonium hexafluorophosphate;
(7) 2,5-Diethoxy-4-N-benzamidobenzenediazonium hexafluorophosphate;
(8) 2-Methoxy-5-methyl-4-N-benzamidobenzenediazonium hexafluorophosphate;
(9) p-Ethoxybenzenediazonium hexafluorophosphate;
(10) 4-Chloronaphthalenediazonium hexafluorophosphate;

(11) p-Diazo-diphenylamine hexafluorophosphate;

(12) p-Diazo-3-methoxydiphenylamine hexafluorophosphate;

(13) p-Diazo-2,5-diethoxy-1-tolylmercaptobenzenediazonium hexafluorophosphate;

(14) 4-N-Methanesulfonamide-2,5 dimethoxybenzenediazonium hexafluorophosphate.

Other suitable and preferred diazonium hexafluorophosphate salts include those disclosed in commonly assigned U.S. patent application Ser. No. 66,401 filed Aug. 14, 1979, the disclosure of which is herein incorporated by reference, including those of the structural formulae:

| Chemical Structure | Chemical Name |
|---|---|
| 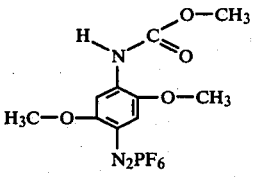 | 4-N-methoxycarbonyl-amino-2,5-dimethoxy-benzenediazoniumhexa-fluorophosphate |
| 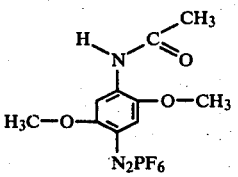 | 4-N-acetylamino-2,5-dimethoxybenzene-diazoniumhexa-fluorophosphate |
| 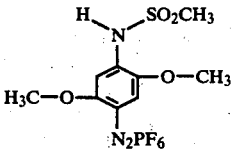 | 4-N-methylsulfonyl-amino-2,5-dimethoxy-benzenediazonium-hexafluorophosphate |
| 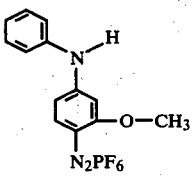 | 4-N-phenylamino-2-methoxybenzene-diazoniumhexafluoro-phosphate |
| 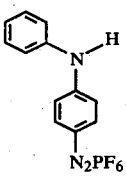 | 4-N-phenylamino-benzenediazonium-hexafluorophosphate |
| 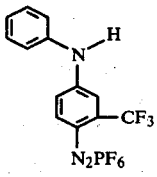 | 4-N-phenylamino-2-trifluoromethyl-benzenediazonium-hexafluorophosphate |
| 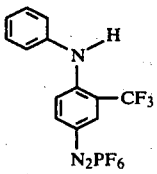 | 4-N-phenylamino-3-trifluoromethyl-benzenediazonium-hexafluorophosphate |

-continued

| Chemical Structure | Chemical Name |
|---|---|
| 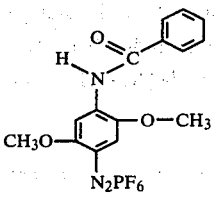 | 4-N-benzoyl-2,5-dimethoxybenzene-diazoniumhexafluoro-phosphate |
| 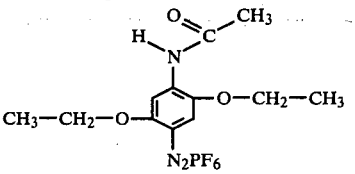 | 4-N-acetylamino-2,5-diethoxybenzene-diazoniumhexafluoro-phosphate |
| 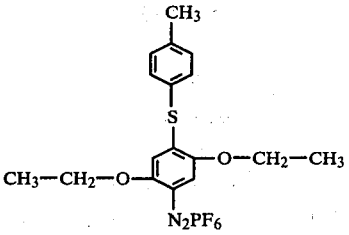 | p-diazo-2,5-diethoxy-1-tolylmercaptobenzene-diazoniumhexafluoro-phosphate |

It will be appreciated that, while the coupler and diazonium salt molecules may bear any one or more substituents which will not interfere with the acid catalyzed unblocking chemistry, at least two sites must be available on the blocked-coupler for any rearrangement and for the subsequent coupling of the unblocked molecule to form azo dye.

The diazotype photoreproduction material according to the invention is conveniently produced by first preparing a solution in pure organic solvents of the two, essential components, i.e., a solution of the diazonium salt and blocked-coupler. The preferred solvents are low molecular weight ketones and alcohols because same, e.g., are typically good solvents for the hexafluorophosphate diazonium salts. In practice, it is of advantage to utilize a mixture of ketone and alcohol solvents. Also advantageously, the blocked-coupler is dissolved in the solvent solution with moderate mechanical stirring, then the diazonium salt is added and dissolved in a similar manner under subdued light, although the components may indeed be added in reverse order. The aforenoted additives, such as benzotriazole, in the amount described herein as well as other desired additives are then slowly stirred into the solution and the mix is filtered to remove insoluble particulates like dust.

While the amounts of the respective components formulated are not especially critical, it has been determined that incorporation of the diazonium salt in amounts of up to 7 parts by weight per 100 g of total mix is eminently practicable, preferably not less than 0.5 parts by weight of total mix. The blocked-coupler can be incorporated in an amount sufficient to achieve a molar ratio thereof to the diazonium salt, of from about 0.1:1 to about 2:1, and preferably from about 0.8:1 to about 1.2:1, respectively.

In a preferred embodiment of the invention, the mix contains a quantity of approximately 1.0 mole of blocked-coupler per approximately 1.0 mole of diazonium salt.

Conveniently, the immediately aforesaid mix is applied to any suitable base substrate, e.g., cellulose acetate butyrate, cellulose acetate propionate, ethyl cellulose, silica/polyvinylbutyral, polyvinylacetate, and preferably to coatings of the aformentioned materials borne by a transparent or opaque polyethylene terephthalate (polyester) film base, by imbibition or bead coating such that approximately 30 grams of mix are laid down per square yard. This consumption varies according to the specific components utilized, the type and thickness of the polymer precoating, and the image density desired. Preferably, the subbed base is overcoated with a layer of cellulose ester, ether, or the like; or the coating can itself comprise a like matrix resin in addition to the solution of the imaging chemicals. A representative film prepared according to the invention would comprise a 0.92–7 mil bond coated polyester base, overcoated with, e.g., a 0.25 mil matrix resin (for example, cellulose acetate propionate) overcoating including the imaging chemicals. Other suitable substrates include the conventional diazo paper bases, textile substrates, nonwovens, etc. See generally the U.S. Pat. No. 3,976,491 to Desjarlais.

While the imaging components may all be coated in a single layer, a coating of this type may employ two or more diazonium salts to improve photo-speed, and/or color, or it may contain more than a single blocked-coupler.

The resulting film is then imaged with the appropriate light source, preferably heated as described herein to assure unblocking of the coupler by acid cleavage, and the image developed (i.e., the unblocked coupler and unreacted diazonium salt are reacted) in the light-struck areas by exposure to a typical alkaline developing environment, e.g., moist ammonia. The reaction which results in the production of the diazo dye may be illustrated by the following representative sequence:

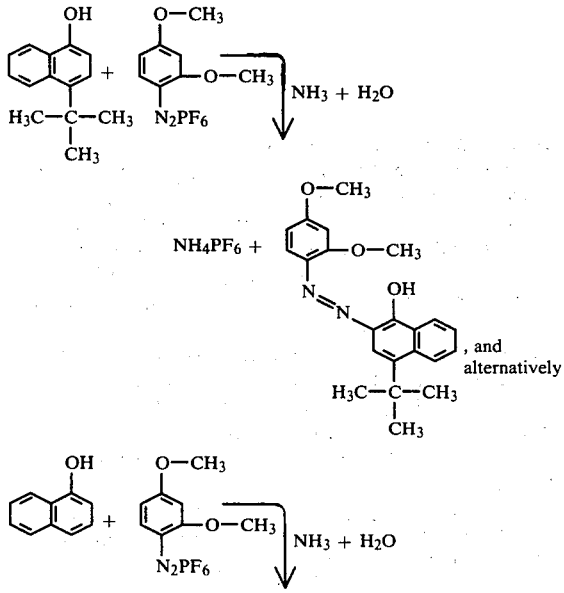

-continued

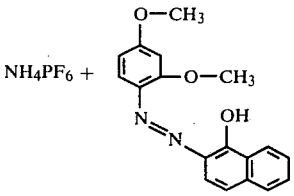

Obviously, other than para-position intramolecular rearrangement is possible, and other isomeric dye forms too are envisaged.

The background areas of the developed film are then preferably cleared in a neutral environment by exposing the same to overall actinic light for a period of about 60 seconds to decompose all the unreacted diazonium salt. While this step is not required it is preferable to do so.

When a clearing step is conducted, it is preferred to have a stabilizer incorporated in the diazography formulation capable of controlling the pH of the film in a manner sufficient to reduce or substantially eliminate the formation a bloom believed to be ammonium dihydrogen phosphate and to reduce acid discoloration of the azo dye as described in a related copending U.S. patent application Ser. No. 160,649 filed June 18, 1980, by Robert C. Desjarlais entitled "Negative-Working Diazo Type Photo Reproduction Having Improved pH Control", the disclosure of which is herein incorporated by reference.

The invention is additionally illustrated in connection with the following Example which is to be considered as illustrative of the present invention. It should be understood, however, that the invention is not limited to the specific details of the Example.

EXAMPLE

A light-sensitive coating formulation comprising the following components was prepared:

| COMPONENT | AMOUNT (gms) | AMOUNT (moles) |
|---|---|---|
| Acetone | 100 | |
| 95% t-butyl-1-napthyl ether (mw 200) | 2.15 | .01 |
| 4-N-Methoxycarbonylamino-2,5-dimethoxy benezenediazoniumhexafluorophosphate (mw 383) | 3.83 | .01 |
| benzotriazole (mw 119) | .035 | .0003 |

The acetone is used to dissolve the ther, then the diazonium salt is stirred into the solution. All operations are carried out in subdued light.

The solution is then applied to 7 mil, cellulose acetate propionate (CAP) precoated polyethylene terephthalate (polyester) using a bead coating technique and the resultant film dried in an oven.

The material is used in the following manner: Imagewise exposure of duplicate film samples is made with a Stauffer #AT20x.15 photographic step tablet in a Scott 716$^{TM}$ microprinter equipped with a gallium doped mercury vapor lamp for 13 seconds.

Each film sample is then heated to a temperature of 190° F. in a Scott SG 24$^{TM}$ preheater for 15 seconds and then passed through an ammonia rich atmosphere using a Teenifax 6000 developer which is set to feed a 22% by weight ammonium hydroxide aqueous solution at the rate of 1.0 cc/min to a hot plate whereby ammonia gas and water vapor are delivered to the film surface. The developed film is then cleared of residual diazo from the back of the film by exposure to actinic light for 60 seconds using the Scott 716™ microprinter.

A blue black image is obtained and density measurements at 3600 A° using a MacBeth Quanta Log Densitometer are conducted. The results are summarized at Table I as run 1.

To provide a control, the above procedure is repeated with the exception that the benzotriazole is omitted from the diazography formulation used to prepare the film samples (i.e., run 3).

The color of each film sample is observed and the results summarized at Table I.

The film samples are also observed for line acuity and analyzed to determine any improvement in D-min. The difference in line acuity between the control and the film sample of run 1 is mostly easily observed in the film sample where the D-min area is contiguous to the D-max area. In the control, a blue haze is observed along the line generated by the contact of the D-min and D-max film portions. In contrast, the film sample of run 1 exhibits a clear, sharp dark line along the D-min-D-max contact area which is indicative of excellent line acuity.

Run 1 is repeated with the exception that urea and thiourea are employed individually in place of benzotriazole using the same molar quantities as shown for benzotriazole in run 1. The results are summarized at Table I as runs 4 and 5 and are similar to those obtained with benzotriazole.

The improvement in D-min of the formulation employing the benzotriazole can be observed from a plot of the diazo density versus the silver density of the step tablet. More specifically, the density of each step on the silver tablet and the associated color density on the negative diazo copy for each corresponding step of the silver tablet are used as the respective x and y coordinates on a plot. The line connecting these points is then drawn. The procedure is repeated with the exception that the benzotriazole is omitted from the formulation and serves as a control.

As may be seen from the FIGURE, the minimum diazo density of run 3, control (i.e., plot III) is about 50% higher than the minimum diazo density of the formulation employing the benzotriazole (i.e., derived from run 1).

The effect of the benzotriazole on the photo speed of the film is observed by repeating the procedure of run 3 (i.e., in the absence of benzotriazole) with the exception that the imagewise exposure time in the Scott 716™ microprinter is reduced to 6.5 seconds and the results summarized at Table 1, run 2.

The above described plot is again drawn using the step tablet of run 2 and is shown in the FIGURE as plot II. As may be seen therefrom the presence of the benzotriazole increases the exposure time needed to achieve diazo densities similar to that observed for formulations which lack benzotriazole. This is advantageous in certain instances, such for example, as where a timer is being used which does not have a high degree of accuracy when short exposure times are employed.

TABLE I

| RUN NO. | ADDITIVE | D-max | D-min | EXPOSURE TIME (sec.) | VISUAL OBSERVATIONS COLOR | VISUAL OBSERVATIONS LINE ACUITY |
|---|---|---|---|---|---|---|
| 1 | benzotriazole | 2.06 | .30 | 13 | Blue-black | Excellent |
| 2 | none | 2.16 | .38 | 6.5 | Blue-black | Poor |
| 3 | none | 2.37 | .45 | 13 | Blue-black | Poor |
| 4 | urea | 1.93 | .26 | 13 | Blue-black | Excellent |
| 5 | thioruea | 1.93 | .26 | 13 | Blue-black | Excellent |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A negative-working light-sensitive diazography formulation comprising (i) at least one light-sensitive hexafluorophosphate salt of a diazonium compound adapted to photolytically cleave into an acid catalyst; (ii) at least one acid labile arylenolic blocked-coupler adapted to be converted in the presence of acid to an active azo-coupling species; and (iii) an effective amount of at least one additive selected from the group of compounds represented by the structural formulae:

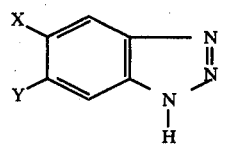

wherein X and Y are selected from the group consisting of hydrogen, chlorine and methyl provided at least X or Y is hydrogen; and $$R-NH-\overset{\overset{\displaystyle X}{\|}}{C}-NH-R'$$

wherein R and R', which can be the same or different, are selected from the group consisting of alkyl of from 1 to about 5 carbons; hydrogen; or together constitute a cyclic hydrocarbon group of from about 2 to about 8 carbons; and X is selected from the group consisting of oxygen and sulfur; said effective amount being sufficient to improve the line acuity of images obtainable from said formulation.

2. The diazography formulation of claim 1 wherein said additive is selected from at least one member of the group consisting of benzotriazole; 5-methylbenzotriazole; 6-methylbenzotriazole; urea, thiourea, dibutylurea; dibutylthiourea; dimethylurea; and dimethylthiourea.

3. The diazography formulation of claim 1 wherein said additive is present therein in an amount sufficient to achieve a molar ratio thereof to the diazonium salt of from about 1:20 to about 1:100.

4. The diazography formulation of claim 1 wherein said acid labile blocked-coupler has the structural formula:

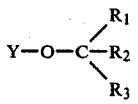

wherein each R, which may be the same or different, is selected from the group consisting of alkyl, aryl, cycloalkyl, aralkyl, and alkaryl, and Y is aryl.

5. The diazography formulation of claim 4 wherein each R is selected from the group consisting of alkyl and aryl.

6. The diazography formulation of claim 1 wherein said acid labile blocked-coupler has the structural formula:

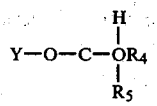

wherein $R_4$ and $R_5$, which may be the same or different, are selected from the group consisting of alkyl, aryl, cycloalkyl, aralkyl, and alkaryl, $R_5$ may also be hydrogen, and Y is aryl.

7. The diazography formulation of claim 6 wherein $R_4$ and $R_5$ is selected from the group consisting of alkyl and aryl.

8. The diazography formulation of claim 1 wherein said acid labile blocked-coupler has the structural formula:

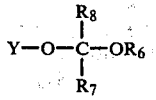

wherein $R_6$, $R_7$ and $R_8$, which may be the same or different, are selected from the group consisting of alkyl, aryl, cycloalkyl, aralkyl, and alkaryl, and Y is aryl.

9. The diazography formulation of claim 7 wherein $R_6$, $R_7$ and $R_8$ are selected from the group consisting of alkyl and aryl.

10. The diazography formulation of claim 1 wherein said acid labile blocked-coupler has the structural formula:

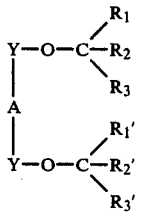

wherein each $R_1$, $R_2$ and $R_3$, which may be the same or different, are selected from the group consisting of alkyl, aryl, cycloalkyl, aralkyl, and alkaryl; Y is aryl, and A is any bridging linkage.

11. The diazography formulation of claim 10 wherein each $R_1$, $R_2$ and $R_3$ is selected from the group consisting of alkyl and aryl.

12. The diazography formulation of claim 1 wherein said acid labile blocked-coupler has the structural formula:

$$Y-O-CH_2-O-CH_2CH_2-OCH_3$$

wherein Y is aryl.

13. The diazography formulation as defined by claim 1 wherein said acid labile blocked-coupler has the structural formula:

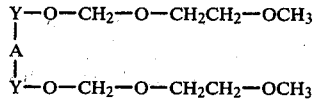

wherein Y is aryl and A is any bridging linkage.

14. The diazography formulation as defined by claim 1 wherein said acid labile blocked-coupler has the structural formula:

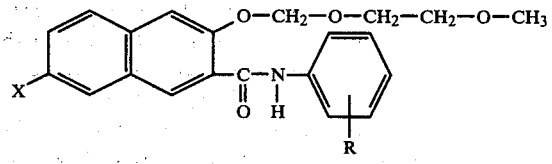

wherein X is selected from the group consisting of hydrogen, bromine, and methoxy, and R can represent alkyl of from about 1 to about 5 carbons; alkoxy wherein the alkyl group is as defined above; acyl; and halogen selected from the group consisting of chlorine, bromine, fluorine and iodine.

15. The diazography formulation as defined by claim 1 wherein said acid labile phenolic blocked-coupler is selected from the group consisting of 1-naphthyltriphenylmethyl ether; 1-butoxy-1-(1-naphthoxy)ethane; t-butyl phenyl-ether; 2-(1-naphthoxy)-3-methyl-butane; 1-(1-butoxy)-1(1-naphthoxy)ethane; dibenzo(d,f)-2,2-dimethyl-1,3-dioxepine; dibenzo(d,f)-2-methyl-2-phenyl-1,3-dioxepine; dibenzo(d,f)-2,2-diphenyl-1,3-dioxepine; 2,2'-di(2-tetrahydropyranoxy)-diphenyl; 2,3-isopropylidene-dioxy-naphthalene; t-butyl-1-naphthyl ether; 1-naphthyl-2-tetrahydropyranyl ether; benzo(e)-2-phenyl-1,3-dioxin; t-butyl-(4-bromo-1-naphthyl)ether; dibenzo(d,f)-2-methyl-1,3-dioxepine; β-methoxyethoxymethyl-α-naphthylether; 3-(methoxyethoxymethoxy)-N-(2-ethylphenyl)-2-naphthalamide; 2-(morpholinosulfonyl)-1-(methoxyethoxymethyl)-naphthyl ether; 3-benzyloxy-2-(methoxyethoxymethyl)naphthyl ether; bis-(3-methoxyethoxymethoxy-1-phenylene)ethylene diether; 8-N-benzoylamino-2-(methoxyethoxymethyl)naphthyl ether; 2,2'-methoxyethoxymethoxybiphenyl; 2-(morpholinocarbonyl)-1-(methoxyethoxymethyl)-naphthyl ether; 5-N-acetylamino-3-(methoxyethoxymethyl)-naphthyl ether; 1,2-bis(2,2'-methoxyethoxymethoxyphenyl)-cyclopropane; 8-N-acetylamino-2-(methoxyethoxymethyl)naphthyl ether; and 3-(2-hydroxyethoxy)-2-(methoxyethoxymethyl)-naphthyl ether.

16. The diazography formulation of claim 1 wherein said acid labile blocked-coupler is t-butyl-1-naphthyl ether.

17. The diazography formulation of claim 1 wherein the light sensitive hexafluorophosphate salt of said diazonium compound is illustrated by the structural formula:

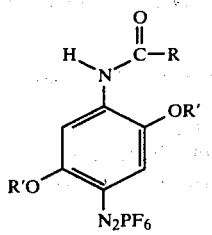

wherein R can represent hydrogen; alkyl or from 1 to about 10 carbons; aryl of from 6 to 10 carbons; cycloalkyl of from 3 to about 6 carbons; aralkyl and aralkyl wherein the alkyl and aryl portions thereof are as described above; alkoxy of from about 1 to about 5 carbons; alkylthio of from about 1 to about 5 carbons; alkoxymethyl wherein the alkyl group thereof has from about 1 to about 5 carbons; aryloxymethyl and arylthiomethyl wherein the aryl groups thereof are as defined above, trifluoroalkyl wherein the alkyl group thereof is as defined above; and furanyl; and R', which can be the same or different can represent alkyl, aryl, cycloalkyl and aralkyl as defined above in connection with R with the proviso that R' cannot be tertbutyl; hydroxyalkyl wherein the alkyl compound contains from 2 to about 5 carbons; methoxyalkyl wherein the alkyl group contains from 2 to about 5 carbons; and allyl of from about 3 to about 5 carbons.

18. The diazography formulation of claim 17 wherein said diazonium salt is selected from the group consisting of 4-N-methoxycarbonylamino-2,5-dimethoxy-benzene diazoniumhexafluorophosphate; and 4-N-acetylamino-2,5-dimethoxybenzenediazoniumhexafluorophosphate.

19. The diazography formulation of claim 17 wherein the diazonium salt is 4-N-acetylamino-2,5-dimethoxybenzenediazoniumhexafluorophosphate.

20. A light-sensitive diazography formulation, comprising (i) at least one light-sensitive hexafluorophosphate salt of a diazonium compound adapted to photolytically cleave into an acid catalyst; (ii) at least one acid labile enolic blocked-coupler adapted to be converted in the presence of acid to an active azo-coupling species; and (iii) an effective amount of at least one additive selected from the group of compounds represented by the structural formulae:

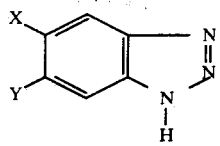

wherein X and Y are selected from the group consisting of hydrogen, chlorine and methyl provided at least X or Y is hydrogen; and

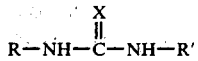

wherein R and R', which can be the same or different, are selected from the group consisting of alkyl of from 1 to about 5 carbons; hydrogen; or together constitute a cyclic hydrocarbon group of from about 2 to about 8 carbons; and X is selected from the group consisting of oxygen and sulfur; said effective amount being sufficient to improve the line acuity of images obtainable from said formulation.

21. A light-sensitive diazotype photoreproduction material, comprising a support member coated with the diazography formulation as defined by any one of claims 1 and 20.

22. The photoreproduction material of claim 21, said support member being a film substrate.

23. The photoreproduction material of claim 22, said diazography formulation including a resin matrix.

24. A negative-working diazography photoreproduction process, comprising imagewise exposing the diazotype formulation as defined by claim 21 to light of a quality and quantity sufficient to photochemically liberate catalytic amounts of acid therefrom, thus unblocking coupler molecules, and thence developing said diazotype material under alkaline conditions such that active azo-coupling species couple with undecomposed diazonium compound in the light-struck areas to form azo dye.

25. The process of claim 24, wherein said diazotype material is heated prior to development to a temperature between about 100° and about to 210° F.

26. The process of claim 24 wherein said diazotype material is heated during development to a temperature between about 100° and about 210° F.

27. The process as defined in claim 24, further comprising clearing said developed diazotype material.

* * * * *